US006280211B1

(12) United States Patent
Tateishi

(10) Patent No.: US 6,280,211 B1
(45) Date of Patent: Aug. 28, 2001

(54) WALL MOUNTED HEATER FAN WITH ELECTRICAL OUTLET

(76) Inventor: Art K. Tateishi, Apt. 202, 25 Warrender Ave., Etobicoke, Ont. (CA), M9B5Z4

( * ) Notice: Subject to any disclaimer, the term of this patent is extended or adjusted under 35 U.S.C. 154(b) by 0 days.

(21) Appl. No.: 09/778,117

(22) Filed: Feb. 7, 2001

(30) Foreign Application Priority Data

Jun. 8, 2000 (CA) ..... 2311011

(51) Int. Cl.[7] ..... H01R 13/44

(52) U.S. Cl. ..... 439/131; 200/51 R; 200/50.28; 439/651; 439/911; 392/362

(58) Field of Search ..... 439/131, 172, 439/136, 911, 651; 200/50.28, 50.29, 50.3, 51.09, 51.05, 51 R, 51.14, 51.12; 392/363–367, 360, 370, 380; 219/486

(56) References Cited

U.S. PATENT DOCUMENTS 3,088,004 * 4/1963 Mueller ..... 200/50.28
3,723,679 * 3/1973 Carney ..... 200/51 R
4,091,246 * 5/1978 Donofrio et al. ..... 439/911
4,196,323 * 4/1980 Napoli ..... 200/51.05
4,345,122 * 8/1982 Janniello ..... 200/50.29
4,503,293 * 3/1985 Knecht ..... 200/50.28
4,752,423 * 6/1988 Wong ..... 219/370
4,873,422 * 10/1989 Streich et al. ..... 219/370
5,239,610 * 8/1993 Shao ..... 174/54
5,641,420 * 6/1997 Peterson et al. ..... 219/536
5,900,684 * 5/1999 Lam ..... 439/188
5,949,652 * 9/1999 McAnally et al. ..... 439/911

* cited by examiner

*Primary Examiner*—Brian Sircus
*Assistant Examiner*—Phoung K T Dinh

(57) ABSTRACT

An electrical appliance has a plug receptor to receive the plug of another appliance such that both appliances can draw power from a single electrical outlet. The appliance of the present invention is operable at different wattages and has a switch which is movable to different switch settings to determine the wattage at which the appliance is operating. When the switch is set such that the appliance operates at a high wattage, the plug receptor is blocked from access to the plug of the other appliance to prevent over loading of the electrical outlet.

10 Claims, 4 Drawing Sheets

FIG. 1.
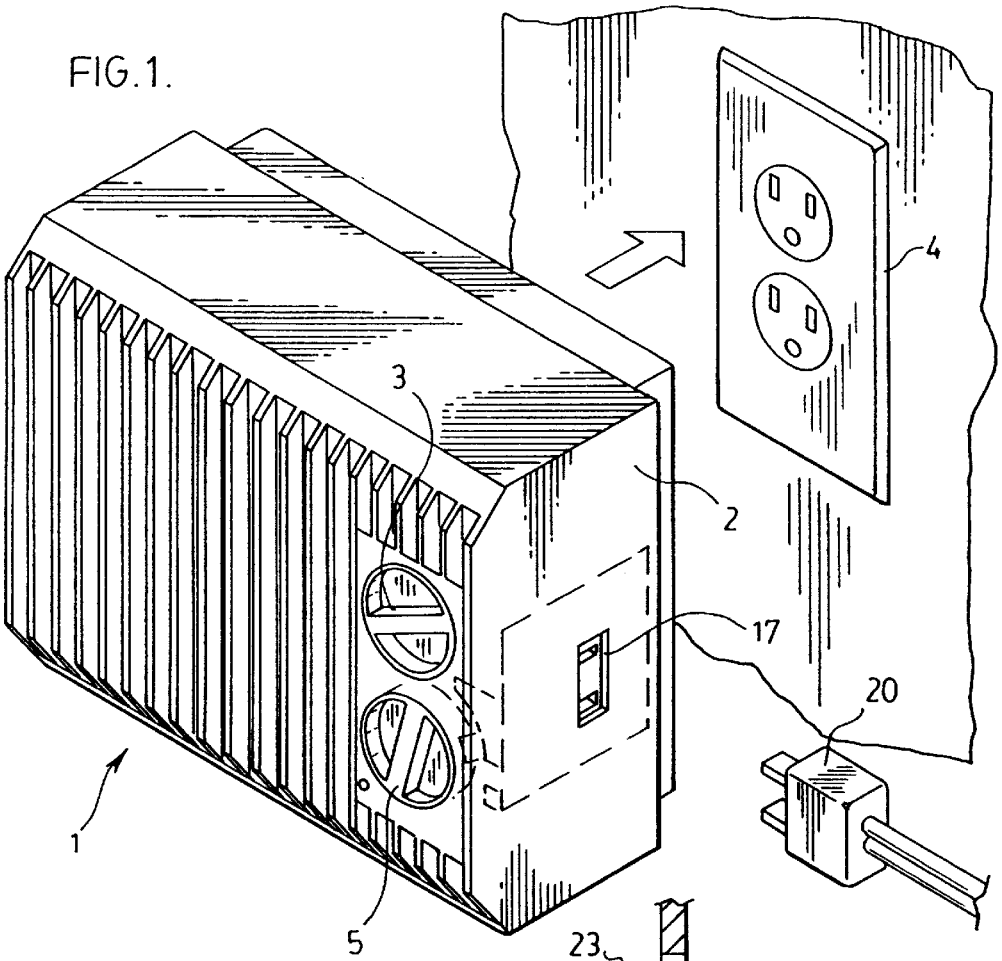
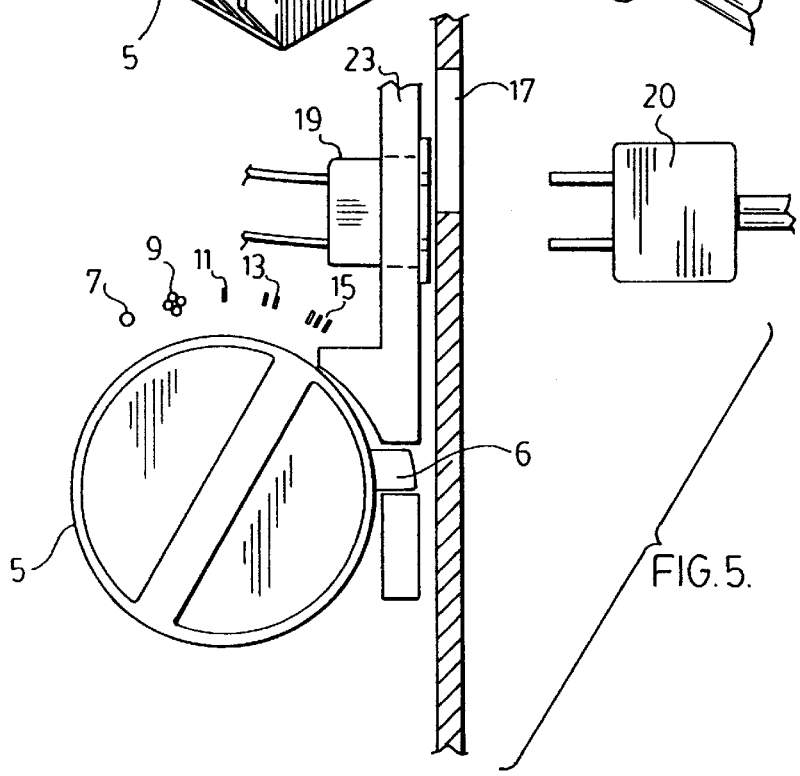
FIG. 5.

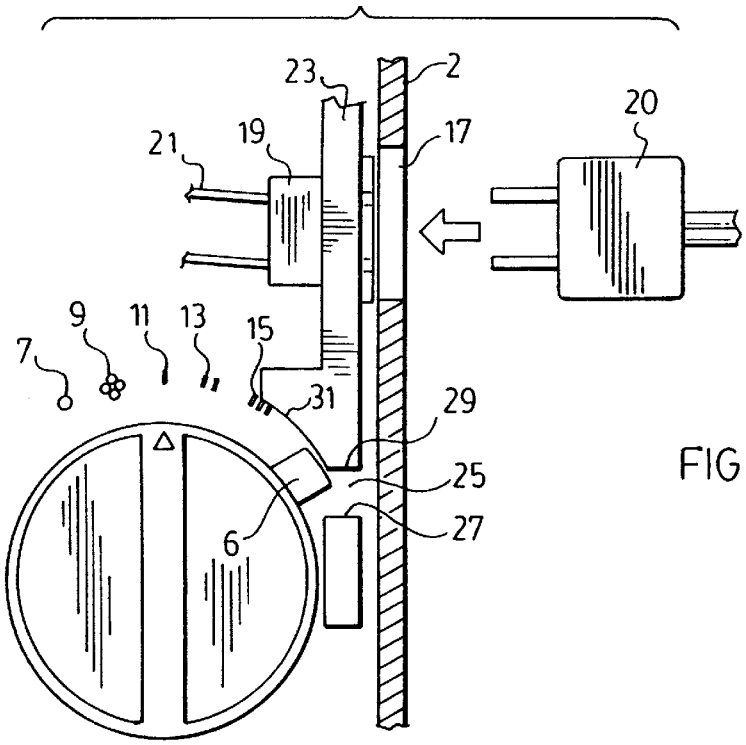
FIG. 4.
FIG. 6.
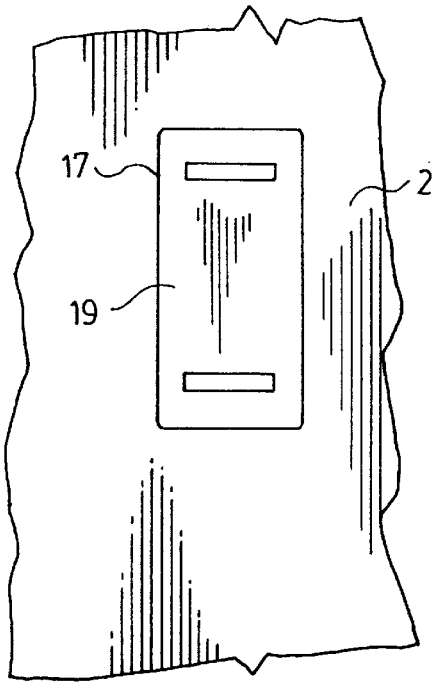
FIG. 7.
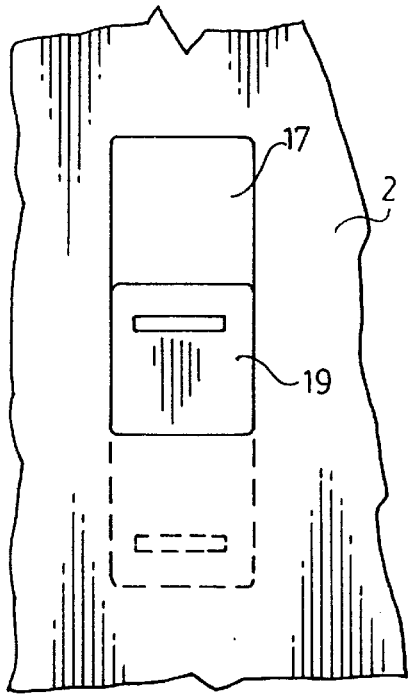

WALL MOUNTED HEATER FAN WITH ELECTRICAL OUTLET

FIELD OF THE INVENTION

The present invention relates to an electrical appliance with its own plug receptor for receiving the plug of another electrical appliance. Through the provision of the plug receptor, both appliances draw power through a common electrical outlet.

BACKGROUND OF THE INVENTION

A typical electrical wall outlet is one which has receptacles for the plugs for two separate electrical appliances. However, there are instances where the plugging in of a single appliance may block both of those receptacles. For instance, if the appliance has an overly large plug such as an adapter type plug, the plug itself will block both receptacles. In other instances, the plug may be mounted directly to the back of an appliance such as a wall mounted heater fan where the body of the fan blocks the other receptacle.

In the above example, it is possible to put a totally separate plug receptacle into the actual body of the first appliance plugged into the wall outlet. A second appliance can then be plugged into the first appliance whereby both appliances draw power from the same wall outlet.

One serious drawback resulting from the arrangement described immediately above, is that when both of the appliances are operating together they may draw more wattage than can be safely provided from the single outlet. Typically, an electrical wall outlet operates at a maximum of 1500 watts and if the two appliances together require more than 1500 watts, this results in an overloading of the circuit. For this reason, the inclusion of a separate plug has not been allowed to date, for an electrical heater fan having a maximum output at 1500 watts.

SUMMARY OF THE PRESENT INVENTION

The present invention provides an electrical appliance specifically designed to overcome the above problem. More particularly, the electrical appliance of the present invention includes a plug receptor to draw power from a single electrical outlet for both the appliance and a second appliance pluggable into the plug receptor of the appliance.

The appliance of the present invention is operable at different wattage settings and has a switch movable to different switch positions to determine the wattage setting of the appliance. In accordance with the present invention, the plug receptor of the appliance is blocked against plug insertion in at least one of those switch positions which would be the position in which the appliance on its own draws high wattage from the electrical outlet. This helps to prevent overloading of the circuit.

BRIEF DESCRIPTION OF THE DRAWINGS

The above as well as other advantages and features of the present invention will be described in greater detail according to the preferred embodiments of the present invention in which;

FIG. 1 is a perspective view of an electrical wall heater fan according to a preferred embodiment of the present invention;

FIG. 4 is a front view of the control region with the casing of the heater fan removed and with the control in a first operating position;

FIG. 5 is a view similar to FIG. 4 with the control in a second operating position;

FIGS. 6 and 7 are views of the plug receptacle on the side of the heater fan.

DETAILED DESCRIPTION ACCORDING TO THE PREFERRED EMBODIMENTS OF THE PRESENT INVENTION IN WHICH

FIG. 1 shows an electrical heater fan generally indicated at 1 which plugs into an electrical wall outlet 4. The heater fan which mounts directly to the wall by an electrical plug (not shown) at the back of the heater fan. The main casing 2 of the heater fan blocks the unused receptacle in the wall outlet.

Figure 2:
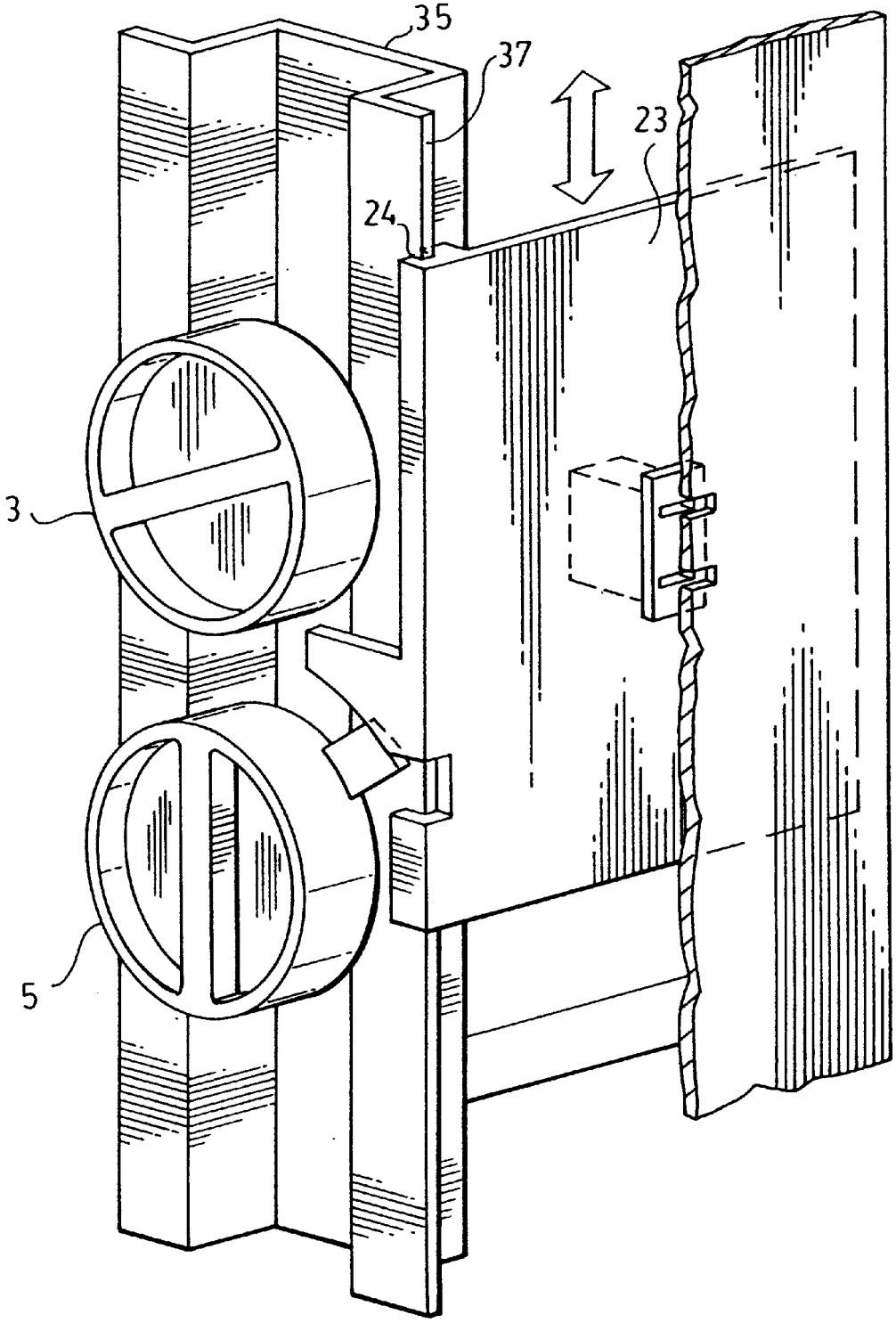
FIG. 2 is an enlarged perspective view of the control region of the heater fan of FIG. 1.

The heater fan has first and second rotating controls 3 and 5 respectively. Control 3 sets the operating temperature for the heater fan when it is used in a heater mode and control 5 is a rotating switch movable to a number of different switch positions as shown in FIGS. 2 and 4 of the drawings. These positions comprise an off position 7, a fan position 9 where the unit operates strictly as a fan without any heater activity and first, second and third heater positions 11, 13 and 15 respectively. The operating wattages for these three heater switch positions are 500 watts in switch position 11, 1000 watts in switch position 13 and 1500 watts in switch position 15. The 1500 watt setting is the maximum wattage that should be drawn from electrical outlet 4.

Figure 3:
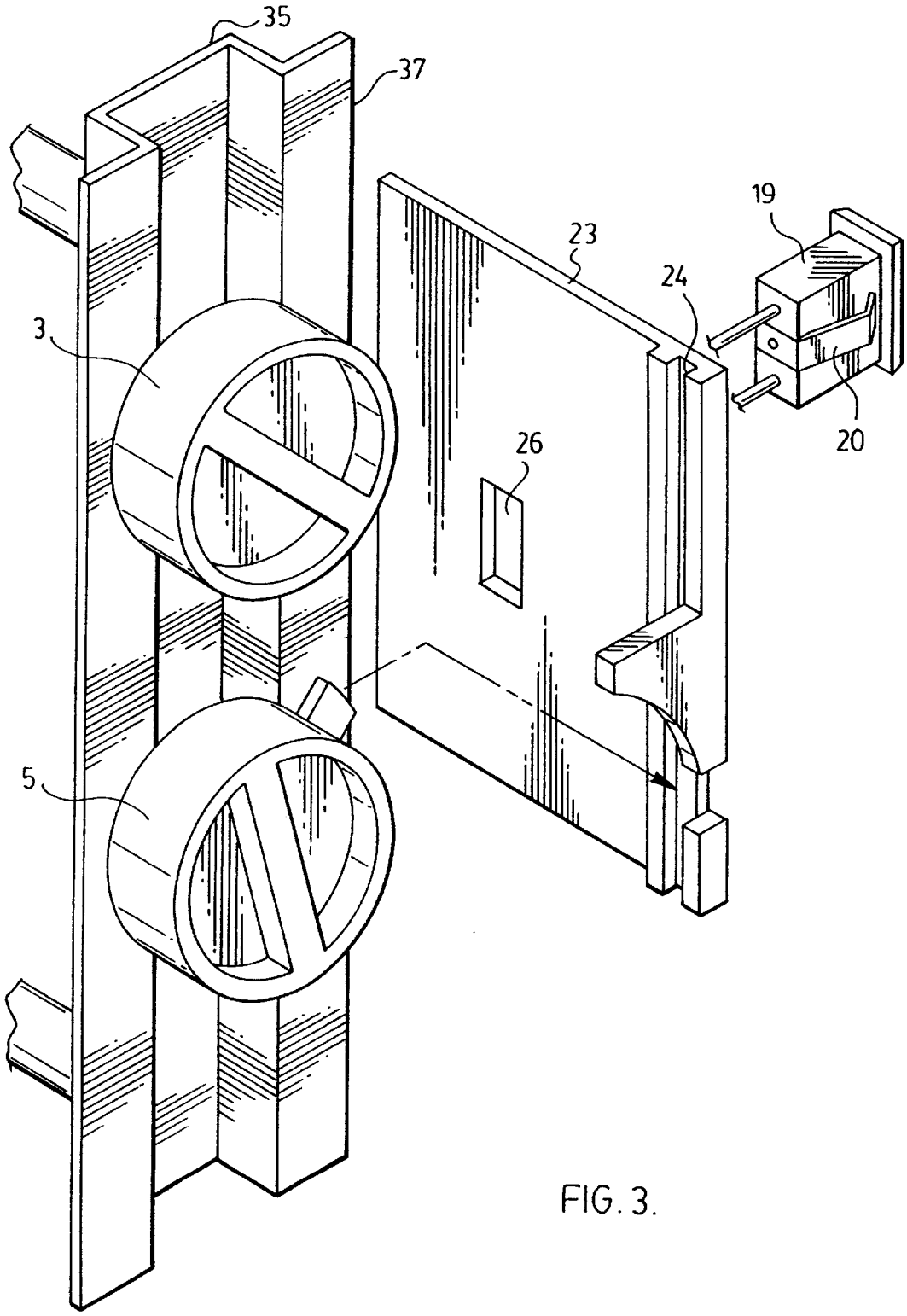
FIG. 3 is an exploded perspective view of the control region shown in FIG. 2.

As well seen in FIGS. 3 through 5, heater fan 1 includes its own plug receiver 19 for receiving a plug 20 of a second electrical appliance pluggable into the heater fan. However, this plug can only be fitted into the plug receptor in certain positions of switch 5 as will be described later in detail.

Plug receptor 19 is wired at 21 back to the plug of the heater fan so that power drawn from electrical outlet 4 operates both the heater fan as well as any second appliance plugged into the heater fan.

The plug receptor is mounted within a plate 23 supported by the heater fan housing. This plate which is best shown in FIGS. 2 and 3 is movable by rotation of switch 5 to in turn moves plug receptor 19 to and away from a plug receiving position. When plug receptor 19 is in the plug receiving position, it aligns with an opening 17 provided in the main casing 2 of the heater fan as shown in FIG. 1 of the drawings. This position is also shown in FIG. 6 of the drawings. Rotation of switch 5 and in the embodiment shown, rotation of the switch to the switch setting 15 causes plug receptor 19 to move out of alignment with casing opening 17 as shown in FIG. 7 of the drawings.

As will be appreciated in the FIG. 3 position, the plug receptor is accessible to receive plug 20, whereas in the FIG. 5 position, plug 20 cannot be inserted into the plug receptor.

FIGS. 2 and 3 show the interior construction of the control region of the heater fan. More specifically control knobs 3 and 5 are mounted in a channel member 35 having an extended edge 37. Plate 23 has a grooved region 24 which engages with and rides along edge 37 of channel member 35 to guide up and down sliding movement of the plate.

Plug receptor 19 includes a spring clip 20 and plate 23 includes a receiving opening 26. The plug receptor pushes into this opening over spring clip 20 which snaps to lock the receptor in its fully inserted position within the plate. The wires on the receptor are sufficiently slack so as not to inhibit movement of the receptor.

As will be seen in FIGS. 4 and 5 of the drawings, switch 5 includes a tooth 6. This tooth produces sliding movement of plate 23 and the receptor 19 carried by the plate as follows.

When switch 5 is in any one of the switch positions 7, 9, 11 or 13, plate 23 holds receptor 19 aligned with casing opening 17. This is the FIG. 4 arrangement. The switch never moves plate 23 as the switch itself is moved between any of these particular settings.

However, when the switch moves to switch setting 15 as shown in FIG. 5, tooth 6 engages within an opening 25 of plate 23. Opening 25 is bordered to its bottom side by plate surface 27 against which the switch tooth drives to slide the plate downwardly. When the plate is slid downwardly, it carries plug receptor 19 out of alignment with casing opening 17 as shown in FIG. 5 of the drawings. Accordingly, when the heater fan is operating at 1500 watts, the maximum wattage to be drawn from receptacle 4, no further appliance can be added to the circuit which could otherwise overload the circuit and create a hazardous situation.

As switch 5 is rotated back to the switch setting 13 tooth 6 drives against plate surface 25 on the upper side of opening 25 in plate 23. This causes the plate to slide back up to the FIG. 4 position where receptor 19 is once again available to receive plug 20. Once plate 23 reaches the FIG. 4 position, tooth 6 rides along a cammed surface 31 of the plate which allows the switch to move without further pushing on the plate.

It is to be understood from the above that although the description refers specifically to switch setting 15 as being the only switch setting in which plug receptor 19 is away from the plug receiving position, the heater fan could equally as well be set up so that switch setting 13 or even switch setting 11 would be a blocked position for the plug receptor.

In accordance with a preferred embodiment of the invention, the heater fan will be provided with a warning to indicate that no more than a total of 1500 watts should be run through it. This should preclude the end consumer from attempting to overload the circuit in various different operating settings of the heater fan.

Although various preferred embodiments of the present invention have been described in detail, it will be appreciated by those skilled in the art that variations may be made without departing from the spirit of the invention or the scope of the appended claims. For example, it is to be understood that the concept of the invention is equally applicable to appliances other than the heater fan specifically described above.

The embodiments of the invention in which an exclusive property or privilege is claimed are defined as follows

1. An electrical appliance having a plug receptor to draw power from a single electrical outlet for both said appliance and another appliance pluggable into said plug receptor, said appliance being operable at different wattage settings and having a switch movable to different switch positions to determine the wattage setting, said plug receptor being blocked against plug insertion in at least one of said switch positions.

2. An electrical appliance as claimed in claim 1, wherein said plug receptor is movable to and away from a plug receiving position by said switch.

3. An electrical appliance as claimed in claim 1 wherein said appliance is a heater fan.

4. An electrical appliance as claimed in claim 2, wherein said electrical appliance is a heater fan and wherein said wattage settings comprise a 500 watt setting, a 1000 watt setting and a 1500 watt setting and wherein said plug receptor is moved by said switch away from the plug receiving position when said appliance is operating at the 1500 watt setting.

5. An electrical appliance as claimed in claim 4, wherein one of said switch positions is a heater off position and wherein plug receptor is in the plug receiving position when said switch is in the heater off position.

6. An electrical appliance as claimed in claim 4, wherein said plug receptor is in the plug receiving position when the heater fan is operating at the 500 watt setting and at the 1000 watt setting.

7. An electrical appliance as claimed in claim 2, wherein said appliance has an outer casing with said plug receptor being located interiorly of said casing shell, said casing having an opening therethrough, said plug receptor being aligned with said opening in said casing when in the plug receiving position and being out of alignment with said opening and being hidden behind said casing when away from the plug receiving position.

8. An electrical appliance as claimed in claim 7, wherein said plug receptor is mounted on a sliding plate within said casing of said appliance.

9. An electrical appliance as claimed in claim 8, wherein said switch is a rotating switch having a tooth which engages and slides said plate to move said plug receptor away from the plug receiving position when said switch is rotated in a first direction and which slides said plate to move said plug receptor back to the plug receiving position when said switch is rotated in a second direction opposite to said first direction.

10. An electrical appliance as claimed in claim 8, wherein said plug receptacle snap locks into an opening of said sliding plate.

* * * * *